US006892770B2

(12) United States Patent
Ratermann

(10) Patent No.: US 6,892,770 B2
(45) Date of Patent: May 17, 2005

(54) SYSTEM AND METHOD FOR INFLATING BALLOONS

(76) Inventor: George W. Ratermann, 601 Pinnacle Pl., Livermore, CA (US) 94550

( * ) Notice: Subject to any disclaimer, the term of this patent is extended or adjusted under 35 U.S.C. 154(b) by 35 days.

(21) Appl. No.: 10/685,753

(22) Filed: Oct. 14, 2003

(65) Prior Publication Data

US 2005/0076968 A1 Apr. 14, 2005

(51) Int. Cl.[7] ..... B65B 1/04
(52) U.S. Cl. ..... 141/114; 141/179
(58) Field of Search ..... 141/114, 137, 141/167, 178, 179, 173, 171, 176, 313, 98; 226/77–86

(56) References Cited

U.S. PATENT DOCUMENTS 3,380,490 A 4/1968 Ellenberg et al. ..... 141/167
3,536,110 A 10/1970 West ..... 141/137
3,616,569 A 11/1971 Litt et al. ..... 46/90
3,616,823 A * 11/1971 Iacono ..... 141/137
4,759,484 A * 7/1988 Richter ..... 226/6
5,067,301 A 11/1991 Shore ..... 53/79
5,370,161 A * 12/1994 Shafer ..... 141/114

OTHER PUBLICATIONS

Website printout: "Stepper Motor System Basics", http:www.ams2000.com/stepping101.html, 10 pgs, no date.

* cited by examiner

*Primary Examiner*—Steven O. Douglas
(74) *Attorney, Agent, or Firm*—Thomas Schneck; Gina McCarthy

(57) ABSTRACT

A system and method for filling balloons. A reusable web holding uninflated balloons attached at the neck is loaded onto a machine for inflating balloons. This machine features a digital motion control apparatus which advances the web a precise distance. After the web advances, a supply nozzle is inserted into the neck of the uninflated balloon directly beneath the nozzle. The balloon is filled, the supply nozzle lifted, and the balloon is removed from the machine. The web is then advanced again and another balloon is filled.

28 Claims, 3 Drawing Sheets

SYSTEM AND METHOD FOR INFLATING BALLOONS

FIELD OF THE INVENTION

This invention relates to machines for inflating balloons.

BACKGROUND ART

Balloons are ubiquitous at a wide variety of events including political conventions, dances, children's birthday parties, fairs, and sales at car dealerships. Balloon displays often require large numbers of balloons, each of which has to be filled. Various methods may be employed to fill balloons. An individual may blow up and tie each balloon by hand or use a tank of compressed air or helium to inflate the balloon, which then has to be tied. These can be quite time-consuming tasks. Additionally, balloons may be damaged or filled to different volumes. Due to the drawbacks of these methods, machines are often used to fill balloons.

The prior art contains several machines for filling balloons. U.S. Pat. No. 3,380,490 discloses a balloon vending machine having balloons fixed by their necks in a flexible loop which is advanced at a turning point. As the loop advances, an uninflated balloon passes into a compartment, where a nozzle comes into contact with the balloon and fills it. A user then removes the balloon, which may have a check valve in the neck to prevent gas escaping from the balloon, and the loop continues to advance.

U.S. Pat. No. 3,536,110 discloses a balloon vending machine with uninflated balloons contained in a flexible conveying belt. The balloons each have check valves in the neck of the balloon. When a balloon in the belt reaches a rest station, a nozzle is attached to the balloon and the nozzle/balloon apparatus travels to a filling station where the balloon is filled. When the balloon is filled, the nozzle is retracted and returned to the rest station. The inflated balloon is ejected from the belt at the filling station.

U.S. Pat. No. 5,067,301 discloses a balloon filling machine having plates with open-ended slots to hold a balloon's neck. The plates are driven by a conveyor loop. A filling head is attached to the neck of the balloon and the balloon is filled. This machine also has means for stretching, twisting, and sealing the neck of the balloon.

All of the prior art discussed here provides a mechanism where uninflated balloons must be physically attached to elements of the machine before filling occurs. This is potentially time-consuming and costly. It is an object of this invention to provide a removable media to which balloons may be attached at the point of manufacture of the media rather than at the point of filling the balloons.

All of the prior art described above requires complex machinery with many moving parts. It is an object of this invention to provide a simple yet precise mechanism for filling balloons.

SUMMARY OF THE INVENTION

The objects are met by a system and method for filling balloons that employ a digital motion control apparatus moving a removable media with attached balloons that may be assembled away from the actual machine that will inflate the balloons. Uninflated balloons are attached by the neck to a reusable web, which has evenly-space openings down the center of the web for attaching balloons. Balloons may be attached to the web at any time before the balloons are to be filled. The web also has a set of perforations along each side of the length of the web. These perforations are for attaching the web to pins on the balloon-inflating machine's tractor drive. The machine's tractor drive with a digitally-controlled stepper motor ensures that the pins powered by the tractor drive move a precise distance at each cycle. Since the pins move a precise distance, the web with attached balloons is advanced accurately to the filling nozzle each time the web is incrementally advanced. The filling nozzle, attached to a canister of compressed gas, is placed in the neck of the balloon to fill the balloon. After the balloon is inflated, the filling nozzle is removed. The balloon can either be manually detached and tied off by the user or the neck of the balloon may contain a clip assembly that both prevents escape of gas from the balloon and detaches it from the machine.

Figure 1:
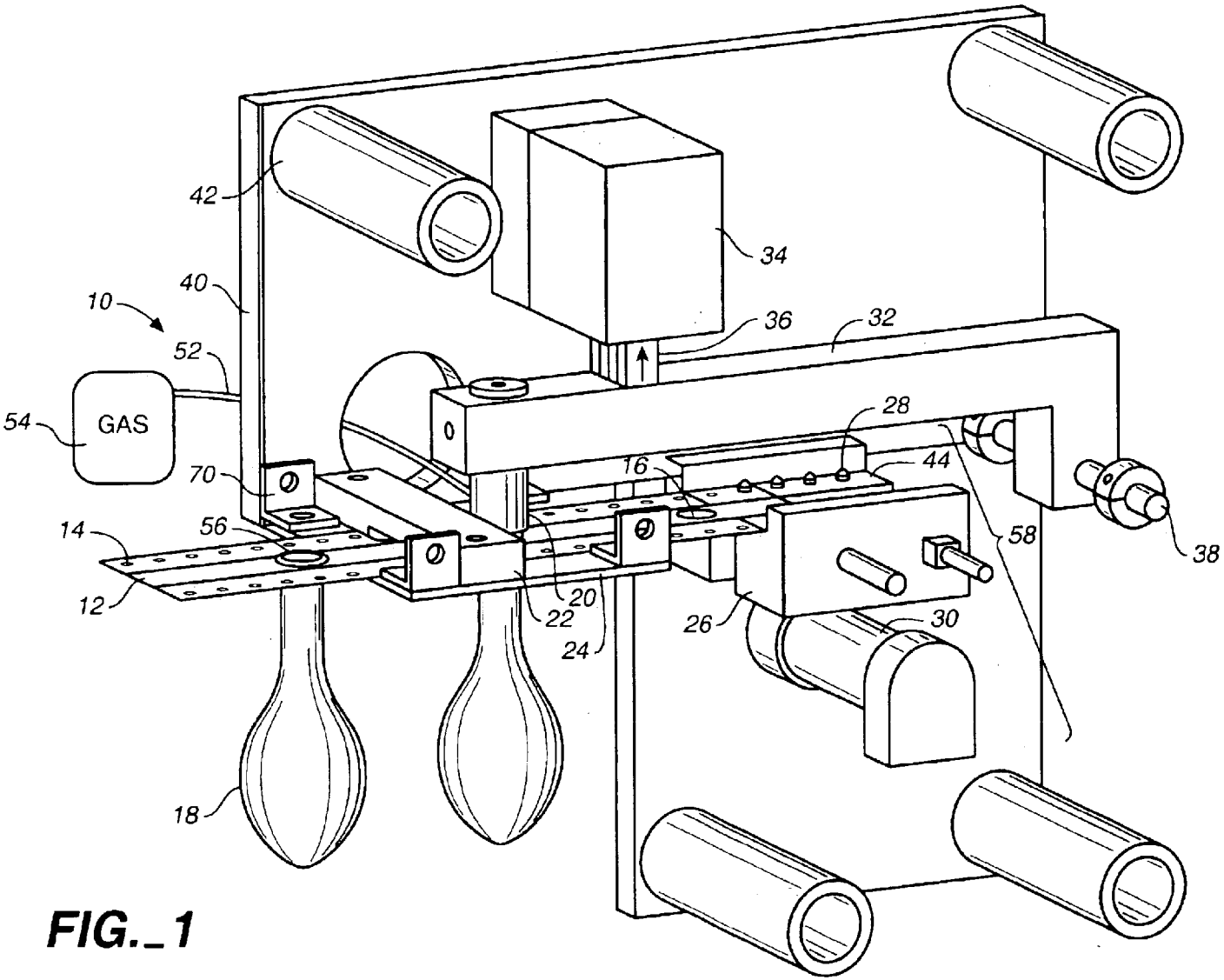
FIG. 1 is a schematic view of a machine for inflating balloons in accordance with the present invention.

FIG, 2*a* is an overhead view of the web attached to the machine shown in FIG. 1.

Figure 2A:
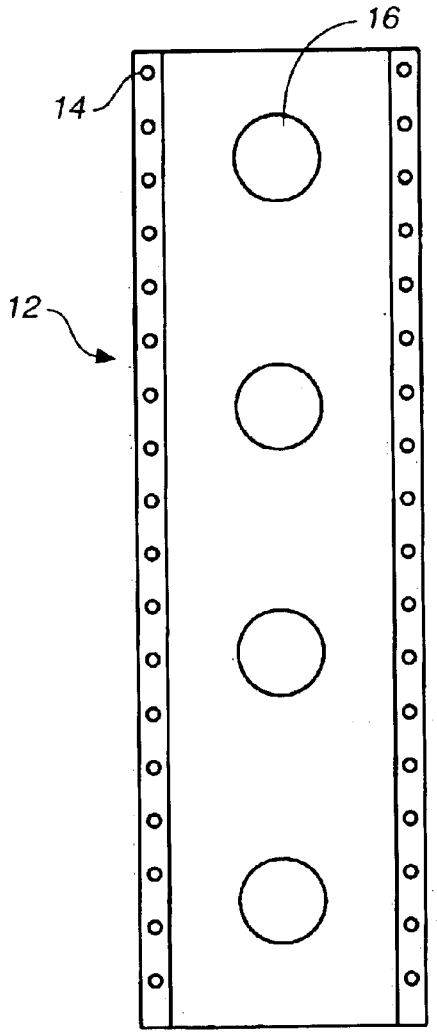
Figure 2B:
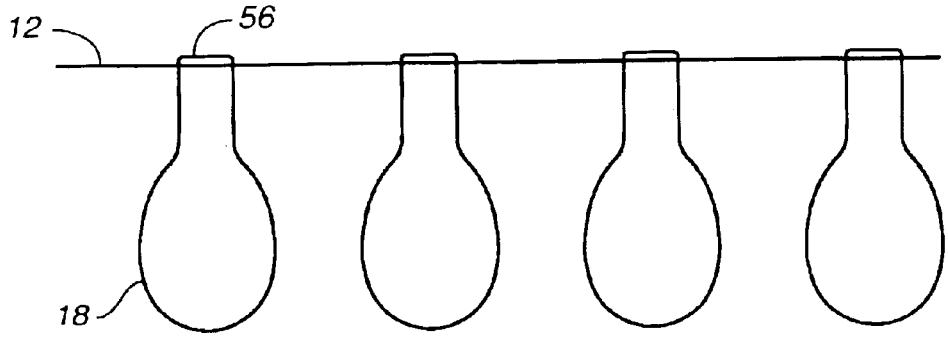

FIG. 2*b* is a side view of the web shown in FIG. 2*a* with uninflated balloons attached to it.

Figure 3A:
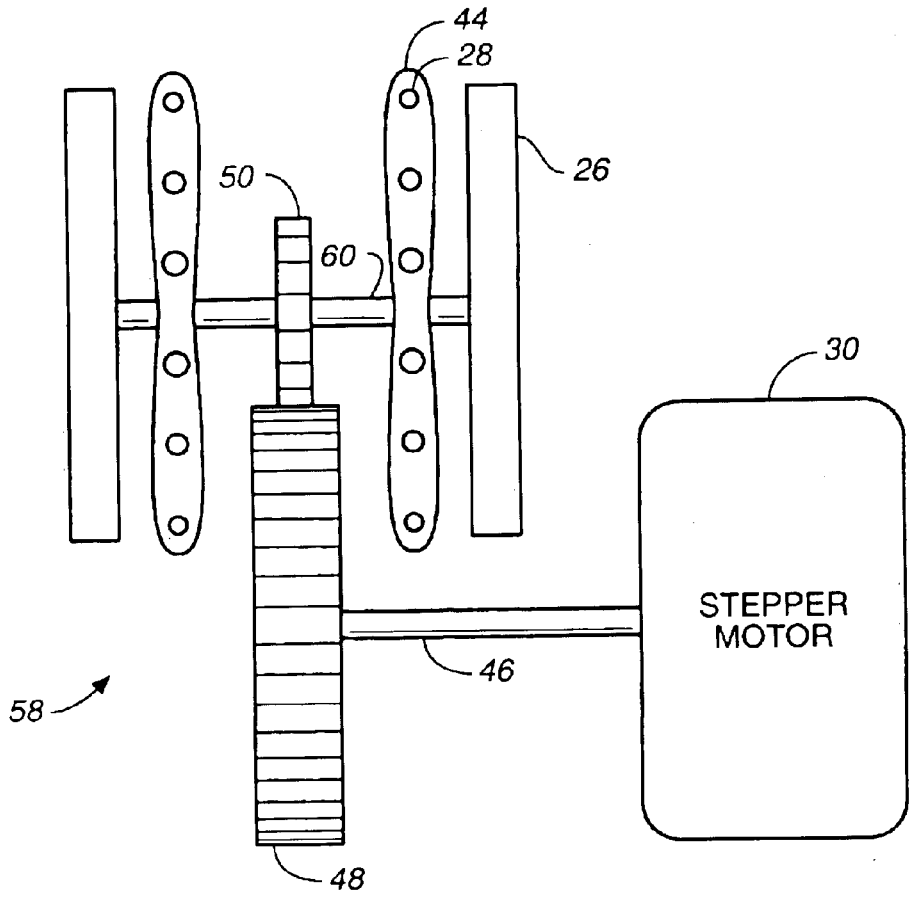

FIG. 3*a* is an overhead view of the tractor drive system of the machine shown in FIG. 1.

Figure 3B:
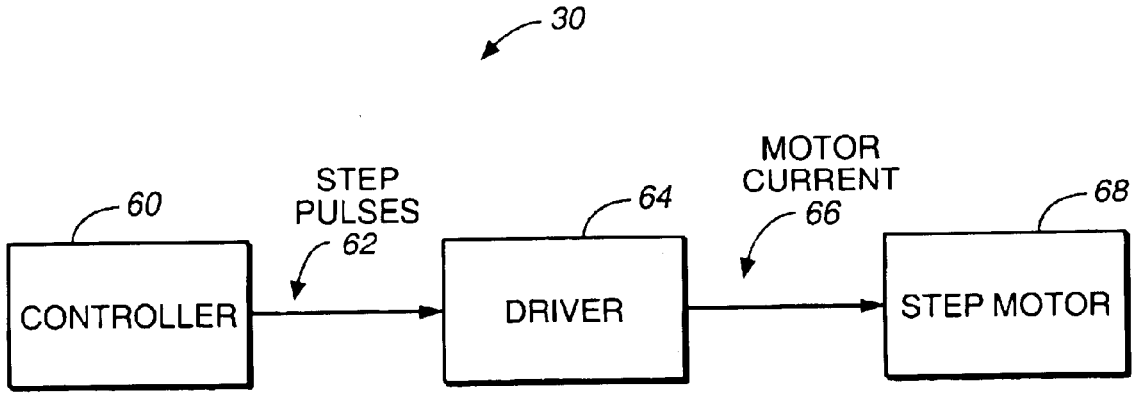
FIG. 3b (PRIOR ART)

FIG. 3*b* is a diagram of the stepper motor used in the tractor drive system shown in FIG. 3*a*.

DETAILED DESCRIPTION OF THE INVENTION

With respect to FIG. 1, balloon filling machine 10 is shown supporting web 12 (see FIGS. 2*a* and 2*b*, below) containing uninflated balloons 18 attached by the neck 56 in evenly-spaced holes 16. Web 12 is loaded onto pins 28 of a tractor drive 58, using tractor feed sprockets similar to such mechanisms in many dot matrix printers. The web 12 is attached to pins 28 of the tractor drive 58 by means of evenly-spaced perforations, or holes, 14 running down each side of the web 12.

A portion of the web 12 is shown in FIG. 2*a*. It is made of fabric, paper, or a synthetic material. Evenly-spaced holes 16 are located in the center portion of the web 12. These holes 16 are sized so as to hold the neck of an uninflated balloon in place. A set of evenly-spaced perforations 12 runs down either side of the web 12. This set of perforations 12 is sized so as to fit on the pins of the machine's tractor drive. A specific dye cut may be used to produce a web with appropriately-sized holes 12, 16.

A side view of the web 12 holding uninflated balloons 18 is shown in FIG. 2*b*. The balloons 18 are held in place by their necks 56. The uninflated balloons 18 may be loaded into the web 12 at any point prior to the web 12 being attached to the tractor drive. In one embodiment, the loaded web 12 containing any number of balloons, may come packed in a box. Depending on the length of the boxed web 12, the machine operator may only have to load the packaged web 12 onto the machine's tractor drive once and still have hundreds of balloons 18 filled.

As mentioned above, the tractor drive 58, shown in detail in FIG. 3*a*, advances the web a precise distance at each cycle (the distance is determined by the separation of holes 16 containing balloons 18). In this embodiment, the drive 58 is powered by a stepper motor 30 (see FIG. 3*b*, below). For each step, or cycle, of the stepper motor 30, the stepper motor 30 turns a first gear 48 which is linked with the stepper motor by a shaft 46. The movement of the first gear 48 causes a second gear 50 to move. This second gear 50 is mounted on a second shaft 60 upon which are mounted two wheels 44, each having a set of evenly-spaced pins 28 running along the rims of the wheels 44. The second shaft 60 is mounted in casings 26. The movement of the second shaft 60 causes the wheels 44 to turn together. The pins 28 on each wheel 44 are aligned to the pins 28 on the opposite wheel 44, ensuring that the web 12 is advanced smoothly.

The stepper motor 30 is digitally controlled. The elements of the stepper motor system 30 are shown in FIG. 3*b*. A controller 60 associated with the motor 30 is a microprocessor for generating step pulses 62 for the driver 64. The driver 64 converts the step pulses 62 into the motor current 66 to run the step motor 68, which converts the motor current 66 into mechanical shaft rotation. "Stepper Motor System Basics," http://www.ams2000.com/stepping101.html. Since the stepper motor 30 is digitally controlled, its movement at each step or cycle is very precise.

Referring again to FIG. 1, the web 12 with uninflated balloons 18 is attached to the pins 28 of the wheels 44 of the tractor, drive 58. The wheels 44 of the tractor drive 58 form a sort of track to guide the web 12. The motor 30 causes the wheels 44 to turn, advancing the web 12 attached to the tractor drive 58 as the pins 28 turn with the wheels 44. As the wheels 44 and the web 12 advance, the pins 28 on the wheels 44 catch the next set of holes 14 of the advancing web 12 and an uninflated balloon 18 nested in the web 12 is delivered to a nozzle to be filled with a gas mixture, for instance, either air, helium, nitrogen, argon or some combination of these gases. The nozzle 20 is inserted into the neck 56 of the uninflated balloon 18. After the balloon 18 is inflated, the nozzle 20 is removed. The balloon 18 may be manually removed and tied or, in another embodiment, a clip assembly, which both ejects the balloon 18 from the nozzle 20 after filling and ensure that the gas does not escape from the filled balloon 18, may be inserted in the neck 56 (for instance, when the balloon 18 is first inserted in the web 12).

The nozzle 20 is connected to a canister 54 supplying the gas mixture by a hose 52. The nozzle 20 in this embodiment is attached to an arm 32 which raises and lowers the nozzle 20. A set collar 38 provides a pivot point for the arm 32, allowing it to be raised and lowered by a solenoid 34 which, when activated, pulls the arm 32 up by means of an attachment point 36. The solenoid 34 is linked with the tractor drive system 58 (for instance, with the stepper motor's controller, discussed above in FIG. 3*b*) so that the nozzle 20 is lowered after the web 12 is advanced. This arrangement is not the only manner in which the nozzle 20 may be inserted and retracted from the balloon neck 56; this arrangement is for explanatory purposes only and is not intended to limit other possibilities.

The portion of the web 12 containing the balloon 18 to be filled rests on a support plate 24. This plate 24 supports that section of the web 12 when the nozzle 20 is inserted into the balloon neck 56. The plate 24 is grooved to allow passage of the balloon 18 to the nozzle 20. A tension box 22 is mounted on the support plate 24. This box 22 creates tension in the web 12 so the pins 28 on the tractor drive 58 can grab the advancing web 12. As noted above, the wheels 44 of the tractor drive 58 move a precise distance at each step, which ensures that uninflated balloons 18 are in registration with the nozzle 20. If there was too much play in the web 12, and the pins 28 could not grab the perforations 14 in the web 12, the uninflated balloons 18 and the nozzle 20 might not be aligned. The tension box 22 can be a simple weight on the web 12 or it may contain an idler wheel which makes sure the web 12 is taut.

The portion of the web 12 that is advanced past the tractor drive system 58 does not interfere with the balloon-filling process. A tray to collect the web may be attached to the machine or the web 12 may be left alone to eventually gather on the floor or some other surface. The web 12 may be recycled by again loading it with uninflated balloons 18.

A backboard 50 or similar support structure may be used to hold the components of the machine 10 in place. In this embodiment, the solenoid 34, tractor drive 58, set collar 38, and support plate 24 are all attached to the backboard 50. The components may be attached by various means such as glue or, as shown for the support plate 24, bolts or screws 70. The machine 10 can be freestanding or attached to another surface. In this embodiment, spacers 42 are provided to allow attachment to another surface. The machine 10 can also be portable, i.e., sitting in a cart with the compressed gas canister 54 and hose 52.

What is claimed is:

1. A system for filling balloons comprising:

a) a tractor drive having two sets of a plurality of projecting pins respectively mounted on a pair of rotatable members driven by a stepper motor, said sets of pins mounted parallel to each other and separated by a distance, said set of pins defining a track;

b) a web having:

i) two sets of a plurality of evenly-spaced perforations, said sets of perforations parallel to each other along each side of a length of the web, wherein the plurality of perforations are sized to fit the projecting pins of the tractor drive such that the tractor drive may engage and pull said web along the track; and ii) a plurality of evenly-spaced openings located between the sets of evenly-spaced perforations, wherein a neck of a balloon may be securely attached at each of the plurality of openings; and c) a reciprocating supply nozzle for filling the balloon, said supply nozzle moveable such that it may come into contact with the neck of the balloon in an opening on the web when said balloon is to be filled and moved away when the balloon has been filled;

wherein the stepper motor causes incremental rotation of the two sets of pins which transfer motion to the web whereby openings in the web are brought into registration with the reciprocating nozzle.

2. The system of claim 1 further comprising a support plate for holding a portion of the web to be loaded onto the track of the tractor drive.

3. The system of claim 2 further comprising a tension block for creating tension in the web so that the sets of perforations in the web are accurately engaged by the sets of pins in the tractor drive, said tension block attached to the support plate.

4. The system of claim 3 wherein the tension block is an idler wheel.

5. The system of claim 1 wherein the reciprocating supply nozzle is attached to a pivot arm.

6. The system of claim 5 further comprising a solenoid for vertically moving the pivot arm.

7. The system of claim 5 further including a pivot point for the pivot arm.

8. The system of claim 1 wherein the web is made of a synthetic material.

9. The system of claim 1 wherein the web is made of paper.

10. The system of claim 1 wherein the web is made of fabric.

11. The system of claim 1 wherein the balloon is filled with one of a group consisting of:

a) air;

b) helium;

c) nitrogen;

d) argon; and e) a mixture of any of the preceding gases.

12. The system of claim 1 further comprising a canister of compressed gas attached to the supply nozzle.

13. A system for filling balloons comprising:

a) a tractor drive having two sets of a plurality of projecting pins respectively mounted on a pair of rotatable members driven by a stepper motor, said sets of pins mounted parallel to each other and separated by a distance, said set of pins defining a track;

b) a web having:

i) two sets of a plurality of evenly-spaced perforations, said sets of perforations parallel to each other along each side of a length of the web, wherein the plurality of perforations are sized to fit the projecting pins of the tractor drive such that the tractor drive may engage and pull said web along the track; and ii) a plurality of evenly-spaced openings located between the sets of evenly-spaced perforations, wherein a neck of a balloon may be securely attached at each of the plurality of openings;

c) a support plate for holding a portion of the web to be loaded onto the track of the tractor drive;

d) a tension block for creating tension in the web so that the sets of perforations in the web are accurately engaged by the sets of pins in the tractor drive, said tension block attached to the support plate; and e) a reciprocating supply nozzle for filling the balloon, said supply nozzle moveable such that it may come into contact with the neck of the balloon in an opening on the web when said balloon is to be filled and moved away when the balloon has been filled;

wherein the stepper motor causes incremental rotation of the two sets of pins which transfer motion to the web whereby openings in the web are brought into registration with the reciprocating nozzle.

14. The system of claim 13 wherein the tension block is an idler wheel.

15. The system of claim 13 wherein the supply nozzle is attached to a pivot arm.

16. The system of claim 15 further comprising a solenoid for vertically moving the pivot arm, said solenoid attached to the pivot arm.

17. The system of claim 15 further including a pivot point for the pivot arm.

18. The system of claim 13 wherein the web is made of a synthetic material.

19. The system of claim 13 wherein the web is made of paper.

20. The system of claim 13 wherein the web is made of fabric.

21. The system of claim 13 wherein the balloon is filled with one of a group consisting of:

a) air;

b) helium;

c) nitrogen;

d) argon; and e) any of the preceding gases.

22. The system of claim 13 further comprising a compressed canister of gas attached to the supply nozzle.

23. A method for filling balloons comprising:

a) loading a plurality of uninflated balloons onto a web at uniformly-spaced locations such that the neck of each of the plurality of balloons is securely attached at an opening in the web;

b) providing a plurality of evenly-spaced perforations on opposed sides of the web;

c) engaging the perforations in the web with two sets of pins on a tractor drive, said set of pins defining a track;

d) advancing the web in increments along the track with the tractor drive such that the neck of one of the plurality of balloons is brought into contact with a supply nozzle after each incremental advance;

e) inserting the supply nozzle into the neck of the balloon;

f) filling the balloon; and g) removing the supply nozzle once the balloon is filled;

h) repeating steps d)–g) until each of the plurality of uninflated balloons is filled.

24. The method of claim 23 further comprising applying tension to the web so that the sets of performations in the web are accurately engaged by the sets of pins in the tractor drive.

25. The method of claim 23 further comprising detaching the balloon.

26. The method of claim 25 wherein the detaching step includes tying off the balloon.

27. The method of claim 26 wherein the tying off is performed manually.

28. The method of claim 23 wherein the balloon is filled with one of the group consisting of:

a) air;

b) helium;

c) nitrogen;

d) argon; and e) a mixture of any of the preceding gases.

* * * * *